US006276118B1

(12) United States Patent
Ilfeld

(10) Patent No.: US 6,276,118 B1
(45) Date of Patent: Aug. 21, 2001

(54) ADJUSTABLE ORTHOPEDIC SADDLE SEAT CUSHION AND METHOD FOR CUSHIONING

(76) Inventor: Lawrence P. Ilfeld, 16 Briston Ct., Bedford, NH (US) 03110

( * ) Notice: Subject to any disclaimer, the term of this patent is extended or adjusted under 35 U.S.C. 154(b) by 0 days.

(21) Appl. No.: 09/238,952

(22) Filed: Jan. 27, 1999

(51) Int. Cl.[7] ..... B68C 1/08
(52) U.S. Cl. ..... 54/44.6; 54/41.1
(58) Field of Search ..... 54/41.1, 44.5, 54/44.6

(56) References Cited

U.S. PATENT DOCUMENTS

| | | | | |
|---|---|---|---|---|
| D. 278,277 | | 4/1985 | Sarnelli | D30/20 |
| 678,202 | * | 7/1901 | Schorp et al. | 54/41.1 |
| 1,005,079 | * | 10/1911 | Simmons | 54/41.1 |
| 3,343,338 | * | 9/1967 | Stubben | 54/44.6 |
| 3,624,695 | | 11/1971 | Roberts, Jr. | 54/46 |
| 4,033,093 | | 7/1977 | Petit | 54/44 |
| 5,284,005 | * | 2/1994 | Jacobi | 54/44.2 |
| 5,548,948 | * | 8/1996 | Smith et al. | 54/66 |
| 5,555,710 | * | 9/1996 | Smith | 54/66 |
| 5,782,070 | | 7/1998 | Knight et al. | 54/66 |
| 5,915,407 | * | 6/1999 | West | 137/223 |

FOREIGN PATENT DOCUMENTS

| | | | | |
|---|---|---|---|---|
| 13842 | * | 4/1897 | (CH) | 54/44.6 |
| 2632623 | * | 12/1989 | (FR) | 54/44.6 |
| 24819 | * | 1/1894 | (GB) | 54/44.6 |
| 553211 | * | 1/1896 | (GB) | 54/44.6 |
| 27359 | * | 10/1903 | (GB) | 54/44.6 |
| 22652 | * | 10/1907 | (GB) | 54/44.6 |
| 1227602 | * | 4/1986 | (SU) | 54/44.6 |

* cited by examiner

*Primary Examiner*—Peter M. Poon
*Assistant Examiner*—Son T. Nguyen
(74) *Attorney, Agent, or Firm*—Devine, Millimet & Branch, P.A.; Paul C. Remus; Kristin Kohler

(57) ABSTRACT

Disclosed is an orthopedic saddle seat cushion, and method for cushioning, to prevent the coccyx of a rider from touching the saddle, to prevent or eliminate lower back discomfort or injury. The cushion allows a substantial area of the rest of the buttocks-seat of the rider to contact the saddle which permits the rider to feel the saddle and thus maintain good control of the animal being ridden. The saddle seat cushion is a circularly shaped outer ring of material that contains a mechanism for inflating the ring, which comprises an inflation tube for putting a gas, or any combination of gases, such as normal air, into the ring to inflate the ring, and an air plug for retaining gas in the ring. There is a fastening mechanism to secure the cushion to the saddle. The fastening is done by a hook and loop fastener comprising at least two strips of hook and loop fastening material wherein at least one of the at least two strips is secured, by adhesive, to a bottom surface of the ring and at least one of the at least two strips is secured, by adhesive, to the saddle such that when the hook and loop fastener is fastened, the cushion ring is secured to the saddle. The device and method thus allows the rider to maintain the contact and feel of the saddle, while having the coccyx protected from jarring, especially during trotting when jarring and injury are common.

18 Claims, 1 Drawing Sheet

ADJUSTABLE ORTHOPEDIC SADDLE SEAT CUSHION AND METHOD FOR CUSHIONING

FIELD OF THE INVENTION

This invention relates to cushions for saddle seats, and methods for cushioning saddle seats. Specifically the invention relates to orthopedic saddle seat cushions to prevent the coccyx of a rider from touching the saddle, to prevent or eliminate lower back discomfort or injury. The invention protects the coccyx, yet allows a substantial area of the rest of the buttocks and seat of the rider to contact the saddle which permits the rider to feel the saddle and thus maintain good control of the animal being ridden.

BACKGROUND OF THE INVENTION

To date there are many types of saddle cushions known which provide comfort to either or both the animal being ridden, the rider or both. Most of the known saddle cushioning devices are designed for use with horseback riding. Some devices provide comfort and support for the rider. Other devices provide comfort and ease of movement for the horse. Listed below are illustrative examples of the state of the art for cushioning devices for both horse and rider. As will be seen, none of these devices for the rider provides significant contact of the rider's seat and legs with the saddle, while protecting the coccyx (tail bone) of the rider.

The U.S. Pat. No. 3,624,695 patent to Roberts discloses a removable saddle seat having a seat section for placement on the seat of a saddle, side jockey sections extending downwardly from each side of the seat section and extending forward of the seat section and towards the pommel of the saddle. There are tie straps in the front and back of the saddle seat. The front straps are located at the side jockeys and tie around the pommel, and the back straps extend behind the cantle and may be tied behind the cantle to hold the seat in place on the saddle. There is at least one connector loop connected to the rearward edge of the seat section of the saddle seat and which is extendable over the cantle of the saddle such that the back tie straps may be inserted through the loop to hold the rear edge of the saddle seat against the cantle of the saddle. The saddle seat is preferably leather, and padded so as to conform to the saddle, and to ensure there are no lumps or protrusions to make the rider uncomfortable.

The U.S. Pat. No. 4,033,097 patent to Petit is directed to a riding saddle formed by two inflatable cushions located on each side of the median plane of a saddle. This saddle is supposed to provide comfort to both the horse and rider. There is a pommel created by a cushion that extends upwards at the front of the saddle, and a cantle which is formed at the rear edge of the seat. There are also inflatable seat cushions on which the rider sits. The pommel is formed by two inflatable bags disposed symmetrically with respect to the median plane of the saddle and connected to the front edge of the seat cushions. The two inflatable bags of the pommel are connected to each other by a rigid bar forming a handle to aid in mounting. The gap between the pommel bags also frees the withers of the horse for greater freedom of movement and comfort for the horse. The use of inflatable cushions for the majority of the saddle components saves an appreciable amount of weight for the saddle. The inflatable portions, the pommel bags, seat cushions and cantle, are constructed in the form of longitudinal sausage-shaped elements which communicate with each other.

The U.S. Pat. No. Des. 278,277 patent to Sarnelli discloses an ornamental design for a riding saddle. The figures appear to show a highly padded, although apparently solid material saddle. The patent does not disclose an inflatable saddle cushion but rather, as does the above patent to Petit, replaces the traditional saddle.

Finally, the U.S. Pat. No. 5,782,070 patent to Knight et al. discloses a method and apparatus for padding and cushioning an equine saddle. This method and apparatus cushions between the saddle and the horse's back, as opposed to cushioning between the saddle and the rider. There are pockets in the saddle pad which house an inflatable cushion to enhance the horse's comfort. This patent is included as representative of the use of cushions in aspects of equine riding relating to comfort of the horse.

The above examples represent a sample of the types of devices known in the art. There are also various other therapeutic saddles, and additions to saddles, for example, saddles including high, rigid back supports for the rider There is a need for a simple, inexpensive, uncomplicated device and method that is usable with traditional saddles, and that is adjustable to the rider's comfort level, yet which still provides the traditional basic seat and feel while protecting the rider's coccyx.

SUMMARY OF THE INVENTION

Briefly, the present invention is an adjustable and removable saddle seat cushion, and method for cushioning. The cushion is comprised of a circularly shaped outer ring of material that is inflatable and which permits insertion and installation of an inflation tube for putting a gas, or any combination of gases, preferably normal air, into the ring to inflate the ring. The ring is formed from a non-smooth material such as vinyl or other similar, suitable material. The inflation tube is a filler tube that is insertable into a filler opening in the ring. There is an air plug device which is insertable into the filler opening to seal the air inside the ring. The ring has attached to its outer surface, a fastening means to attach the ring to a saddle seat. The fastening means is preferably a hook and loop fastener comprising at least two strips of, preferably adhesive backed hook and loop fastening material. At least one of the at least two strips is secured to the bottom surface of the ring, and at least one of the at least two strips is secured to the saddle such that when the hook and loop fastener is fastened, the ring is secured to the saddle. Thus, the saddle seat cushion is removable such that the saddle may be used with or without the cushion. The cushion may be formed in small, medium and large sizes to accommodate differently sized saddles and riders.

The method of cushioning comprises removably securing a bottom surface of a saddle seat cushion to the seat of a saddle, such that a rider's coccyx is protected from impact, yet which allows a substantial area of the rest of a rider's buttocks to contact the saddle seat.

It is therefore an advantage of the invention to provide a cushion to prevent a rider's coccyx from impacting with the saddle, especially during rough gaits such as the trot.

It is another advantage of the invention to provide a cushion that creates an area directly under the rider's coccyx that is separated from the saddle such that the rider's coccyx will not touch the saddle. This is accomplished by providing cushioning under the ischial tuberosities (the two bones on either side of the coccyx that protrude down below the level of the coccyx).

It is a further advantage of the invention to provide a cushion, and method of cushioning that, while protecting the coccyx, still allows a substantial portion of the rest of the rider's buttocks and seat area to contact the saddle and permits the rider to feel the saddle which allows for better riding and better control of the animal.

These and other advantages will become apparent upon review of the following drawings, description of the invention, and the appended claims.

DETAILED DESCRIPTION OF THE INVENTION

Figure 1:
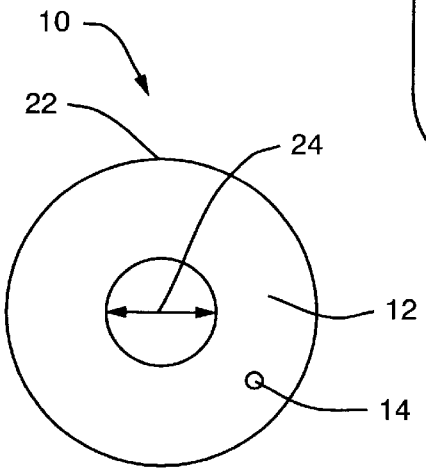
FIG. 1 is a plan view, from above, of the device of the present invention illustrating the basic shape of the cushion, and a location of the filler opening for inflation of the cushion.
Figure 2:
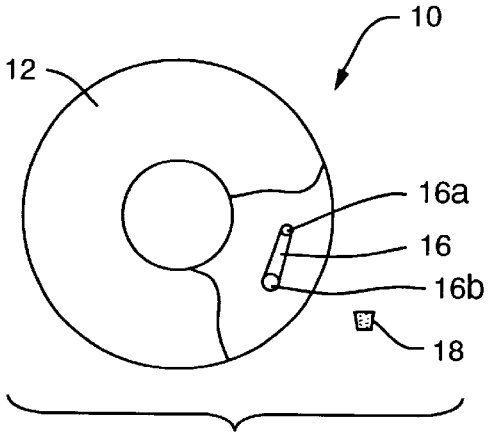
FIG. 2 is a partially cut away view showing the structure of the inflation tube and its insertion into the outer ring of the cushion.

Referring now to the figures, in which like reference numerals refer to like elements throughout, the most basic preferred embodiment of the invention is an orthopedic saddle seat device 10, as shown in FIGS. 1 and 2, comprised of a circularly shaped outer ring of material 12 that contains an inflation device comprising a filler opening 14, an inflation tube 16 and a plug 18, for putting and retaining a gas, or any combination of gases, preferably normal air, in ring 12 to inflate the ring. Ring 12 is preferably formed from a non-smooth material such as vinyl or other suitable non-smooth material such that the rider does not slip or slide on the device 10.

Figure 5:
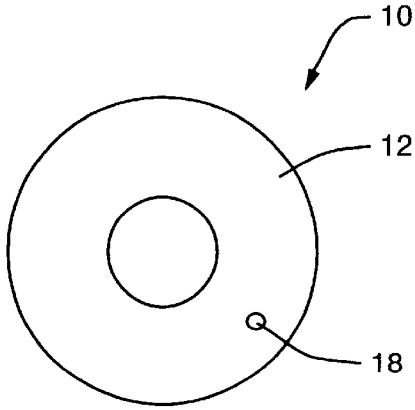
FIG. 5 is a plan view of the cushion showing the air plug device in place in the filler opening of the cushion.

As can be seen in FIG. 2, inflation tube 16 is a filler tube preferably about 4 cm in length, and which includes an opening of about 0.5 cm in size at a first, inflating end 16*a*, and an opening of about 0.2 cm at a bottom end 16*b* that is insertable into filler opening 14 in ring 12. The plug 18, shown in FIGS. 2 and 5, is a roughly T-shaped air plug device of about 1.0 cm in length, which may have a circular flat-heat top, and which is insertable into filler opening 14 to seal the air or other gas inside ring 12 such that when plug 18 is fully inserted, it is essentially flush with the outer surface of ring 12.

Figure 3:
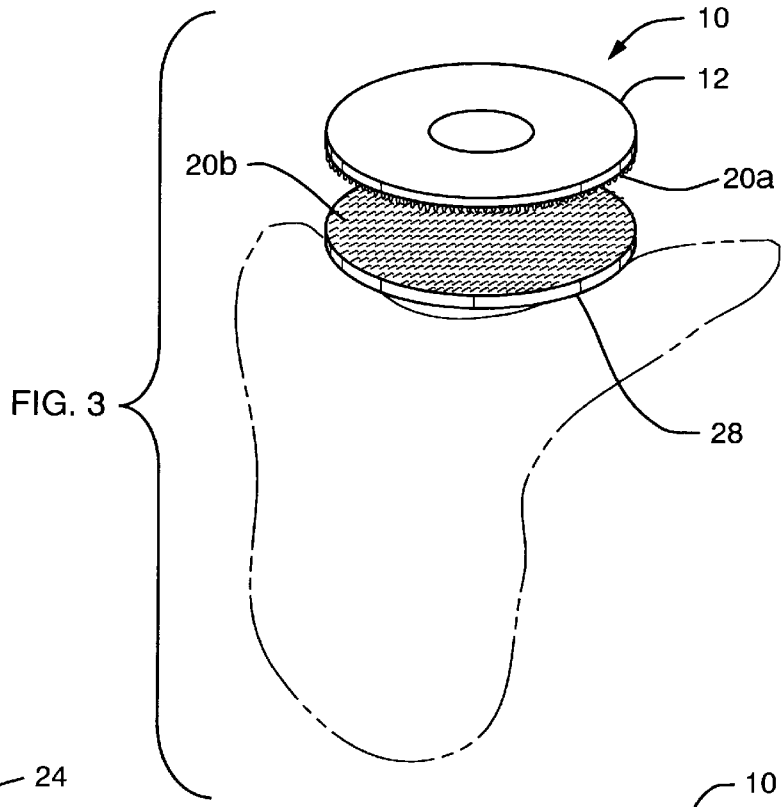
FIG. 3 is a side perspective view showing the preferred means for attaching the cushion to the saddle.

Ring 12 has attached to a bottom area of the outer surface, as best seen in FIG. 3, a fastening means to attach ring 12 to a saddle seat 28. In a preferred embodiment, fastening means 20 is preferably an adhesive backed hook and loop fastener mechanism comprising at least two strips of hook and loop fastening material about 12 cm in length, and about 3 cm in width, wherein at least one of the at least two strips 20*a*, is secured to the bottom surface of ring 12 and at least one of the at least two strips 20*b*, is secured to the saddle seat such that when the hook and loop fastener is fastened, ring 12 is secured to the saddle. The ring 12 is removable from the saddle such that the saddle may be used with or without ring 12, thus avoiding having to have a custom saddle made for riders requiring cushioning of the coccyx while riding.

Figure 4:
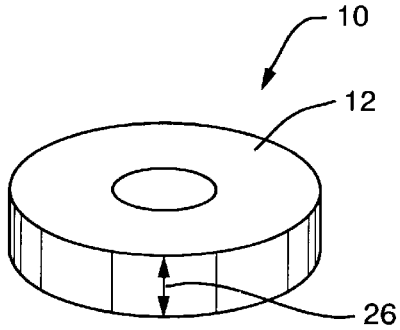
FIG. 4 is a perspective view of the cushion, showing it inflated.

In the embodiment described herein, the device 10 may be formed in small, medium and large sizes to accommodate differently sized saddles and riders such that each rider's coccyx is protected, yet the rider can still feel the saddle. As an example, the outer circumference, shown as reference numeral 22 in FIG. 1, of ring 12 may be about 69 cm for the large size, and the diameter, shown as reference numeral 24 of FIG. 1, of the center opening of ring 12 is about 11 cm for the large size. When inflated, ring 12 is about 7 cm in height, shown as reference numeral 26 in FIG. 4, for all sizes of the cushion device 10. The small, medium, and large sized cushion devices may be formed in different colors in order to aid in differentiation between small, medium, and large sizes.

The method of the present invention comprises cushioning a saddle seat by securing at least one strip of hook and loop fastening material 20*b* to the seat 28 of a saddle, preferably with adhesive, securing at least one strip of hook and loop fastening material 20*a* to the bottom surface of an inflatable ring 12, placing inflatable ring 12 over saddle seat 28 and matching hook and loop fastening material 20*b* on saddle seat 28 with hook and loop fastening material 20*a* on ring 12 to attach inflatable ring 12 to saddle seat 28 to provide cushioning to a rider's coccyx yet still allow the rider to maintain a basic seat and to feel the saddle.

While the above description is merely exemplary, it will be clear to one of ordinary skill in this art, that there may be variations in size, form and detail of the invention without departing from the spirit and scope of the invention as described above and in the appended claims.

Accordingly, what is claimed is:

1. A saddle seat cushion device for preventing a rider's coccyx from contacting the seat of a saddle comprising:

a circularly shaped outer ring of material, removable attached on top of the seat of a saddle, wherein said outer ring of material is not covered by any additional material, thus requiring no disassembly of the saddle during installation or removal of said saddle seat cushion, wherein said ring contains a means for inflating said ring comprising an inflation tube for introducing at least one gas into said ring to inflate said ring, and a plug to retain said gas in said ring.

2. The saddle seat cushion of claim 1 wherein said ring is formed from a non-smooth material.

3. The saddle seat cushion of claim 2 wherein said non-smooth material is vinyl or other suitable non-smooth material.

4. The saddle seat cushion of claim 1 wherein said inflation tube is a filler tube about 4 cm in length, and which includes an opening of about 0.5 cm in diameter at a first, inflating end, and an opening of about 0.2 cm at a bottom end that is insertable into a filler opening in said ring.

5. The saddle seat cushion of claim 4 wherein said air plug is a roughly T-shaped device of about 1.0 cm in length, which has a flat circular top, and which is insertable into said filler opening to seal said gas inside said ring such that when said air plug is fully inserted, it is essentially flush with an outer surface of said ring.

6. The saddle seat cushion of claim 5 wherein said ring has attached to said outer surface, a fastening means to attach said ring to a saddle seat.

7. The saddle seat cushion of claim 6 wherein said fastening means is a hook and loop fastener comprising at least two strips of hook and loop fastening material about 12 cm in length, and about 3 cm in width, wherein at least one of said at least two strips is secured to a bottom surface of said ring and at least one of said at least two strips is secured to said saddle such that when said hook and loop fastener is fastened, said ring is secured to said saddle.

8. The saddle seat cushion of claim 7 wherein said at least two strips of hook and loop fastening material have an adhesive backing thereon, for securing at least one of said at least two strips of hook and loop fastening material to said bottom surface of said ring, and to said saddle respectively.

9. The saddle seat cushion of claim 1 wherein said cushion is formed in small, medium and large sizes to accommodate differently sized saddles and riders.

10. The saddle seat cushion of claim 9 wherein an outer circumference of said ring is about 69 cm for said large size.

11. The saddle seat cushion of claim 9 wherein the diameter of a center opening of said ring is about 11 cm for said large size.

12. The saddle seat cushion of claim 9 wherein said small, medium, and large sized cushions are formed in different colors in order to aid in differentiation between said small, medium, and large sizes.

13. The saddle seat cushion of claim 1 wherein said ring when inflated, is about 7 cm in height.

14. A reversible method for cushioning a saddle seat for a rider, which method requires no disassembly of the saddle itself, comprising the steps of:

securing a fastening material to an outer surface of the seat of a saddle;

securing a mating fastening material to a bottom surface of an inflatable ring;

placing said ring upon said saddle seat; wherein said ring is not covered by any additional material, and attaching said fastening material located on said outer surface of the saddle seat to said mating fastening material located on said ring, thereby removably attaching said ring to the saddle seat to cushion a rider's coccyx and prevent the rider's coccyx from contacting the saddle seat, yet still allow the rider to maintain a normal seat.

15. The method according to claim 14 wherein said fastening material is a hook and loop fastening material.

16. The method according to claim 15 wherein said at least one strip of hook and loop fastening material secured to said seat of said saddle is secured with adhesive.

17. The method according to claim 15 wherein said at least one strip of hook and loop fastening material secured to said ring is secured with adhesive.

18. A removable saddle seat cushion device for preventing a rider's coccyx from contacting the saddle seat comprising:

a substantially circularly shaped outer ring of material which is placed upon the seat of the saddle and not covered by any additional material;

a means for inflating said ring comprising an inflation tube for introducing at least one gas into said ring to inflate said ring, and a plug to retain said gas in said ring;

a fastening means attached to an outer surface of said ring;

a mating fastening means attached to the seat of a saddle and mateable with said fastening means, for securely and removably attaching said ring to the seat of the saddle.

* * * * *